United States Patent [19]

Lewis et al.

[11] Patent Number: 4,964,755

[45] Date of Patent: Oct. 23, 1990

[54] MANHOLE COVER LOCK APPARATUS

[75] Inventors: William F. Lewis; Bert R. Moore, both of Golden, Colo.

[73] Assignee: Lew-Mor, Inc., Golden, Colo.

[21] Appl. No.: 339,756

[22] Filed: Apr. 18, 1989

[51] Int. Cl.[5] ..... F16K 35/10; E02D 29/14

[52] U.S. Cl. ..... 404/25; 49/35; 49/465; 292/7; 292/66; 292/336.3

[58] Field of Search ..... 404/25; 49/35, 41, 465; 292/7, 66, 150, 173, 336.3; 70/168, 169; 220/210

[56] References Cited

U.S. PATENT DOCUMENTS

| | | | |
|---|---|---|---|
| 757,118 | 4/1904 | Hubert | 70/169 X |
| 822,562 | 6/1906 | Tucker | 292/37 |
| 845,182 | 2/1907 | Letts | 70/168 |
| 891,174 | 6/1908 | Hurlburt | 70/161 |
| 1,102,422 | 7/1914 | McKeon | 49/35 |
| 1,204,464 | 11/1916 | Lofton | 404/25 |
| 1,287,290 | 12/1918 | Golden | 49/35 |
| 1,400,399 | 12/1921 | Yaeche | 404/25 |
| 1,458,391 | 6/1923 | Burton | 404/25 |
| 1,610,123 | 12/1926 | Fairweather | 49/35 |
| 1,616,298 | 2/1927 | Arnett | 70/168 |
| 1,903,765 | 4/1933 | Johnson | 70/169 |
| 1,986,203 | 1/1935 | Ivandick | 70/168 |
| 2,363,567 | 11/1944 | Blakeman | 404/25 |
| 3,772,829 | 11/1973 | Chahley | 49/465 |
| 3,797,286 | 3/1974 | Saporito | 70/169 |
| 3,921,494 | 11/1975 | Coe | 404/25 |
| 4,493,199 | 1/1985 | Uyeda | 70/333 R |
| 4,577,478 | 3/1986 | Economopoulos et al. | 70/168 |

*Primary Examiner*—Jerome W. Massie
*Assistant Examiner*—M. Smith
*Attorney, Agent, or Firm*—James R. Young

[57] ABSTRACT

An improved cover lock apparatus comprises a rotatable and axially slidable crank plate connected to a plurality of retractable lock rods. The crank plate is disposed between the cover and a lock plate and is slidably and rotatably mounted to the lock plate. The crank plate has two upwardly protruding lock pins oriented to engage mating holes in the lock plate and is upwardly biased against the lock plate by a spring. When the lock pins are engaged in these holes, the crank plate cannot be rotated to retract the lock rods. Before the crank plate can be rotated to retract the lock rods, the lock pins must be disengaged from the mating holes in the lock plate by forcibly pushing down on the crank plate via a special lock key to overcome the spring bias that normally holds the crank plate pins in the engaged position. Once the crank plate is pushed downward enough to disengage the lock pins, it can be rotated to retract the lock rods.

26 Claims, 3 Drawing Sheets

MANHOLE COVER LOCK APPARATUS

BACKGROUND OF THE INVENTION

1. Field of the Invention

This invention relates to deck plate covers in general and to lockable manhole covers in particular.

2. Description of the Prior Art

Unauthorized removal of manhole covers has been a problem for over a century. For example, manhole covers have been stolen for their value as scrap iron and have also been frequently removed by unauthorized persons who can then access the underground passageways that often contain valuable installations, such as electrical and communications systems, water lines, natural gas lines and the like. A serious problem which has developed recently is the unauthorized removal of manhole covers for the purpose of surreptitiously dumping toxic or hazardous wastes into underground sewer systems. Unlockable manhole covers, while being heavy and awkward, are not particularly difficult to remove as they simply rest on a ledge or flange protruding from a frame or base surrounding the manhole opening.

In response to these problems, several locking manhole covers have been developed over the past century. Many different designs exist, but the most popular designs use at least two locking rods extending radially outward from the underside of the covers to engage the flanges in the support frames, thus locking the covers in place. The rods are extended and retracted by some means, usually a center crank that converts a rotational movement of the crank to a linear movement, which extends and retracts the rods. Another apparatus uses a dog lock device diametrically situated on and extending through the manhole cover to lock it in position.

While these systems succeeded in locking the cover to the manhole, they were usually not very tamper-resistant or required as many as three separate tools to open. Usually the degree to which a given design was tamper-resistant was directly proportional to the complexity, and therefore cost, of the design.

SUMMARY OF THE INVENTION

Accordingly, it is a general object of the present invention to provide an improved locking manhole cover that is highly tamper-resistant, yet easy to use, while also being simple in design and thus easy and inexpensive to manufacture.

It is another object of this invention to provide a tamper-resistant locking manhole cover that requires a special access key.

It is yet another object to provide a tamper-resistant locking device that not only utilizes a single key device, but also requires two distinct, sequential movements, such as first a downward movement and then a rotational movement of the access key before the lock can be disengaged.

Additional objects, advantages, and novel features of the invention shall be set forth in part in the description that follows, and in part will become apparent to those skilled in the art upon examination of the following or may be learned by the practice of the invention. The objects and advantages of the invention may be realized and attained by means of the instrumentalities and combinations particularly pointed out in the appended claims.

In accomplishing these and other objects, there has been provided in accordance with the present invention a manhole cover lock apparatus having a crank plate rotatably and slidably mounted on the manhole cover. The lock rods are pivotally attached to the crank plate as in the prior art, but the rods are mounted so as to allow substantial vertical movement at the crank plate. The rods are guided by suitable lock rod guides near the perimeter of the cover that allow axial extension and retraction of the rods under the annular flange of the manhole. When the rods are extended under the flange, the manhole cover is effectively locked in position. The crank plate has two upwardly protruding lock pins oriented to engage mating holes in the lock plate and is upwardly biased against the lock plate by a biasing spring. When the lock pins are engaged in the holes, the crank plate cannot be rotated. Actuation of the lock is accomplished by the insertion of a special key through a hole in the center of the cover, which is concentric with the axis of rotation of the crank plate. The key bit, which is attached to the shank of the key, passes through a cut out or aperture in the lock plate with a perimeter configuration that matches the particular key bit pattern on the key, thereby allowing the key to be inserted through the lock plate until the key bit is engaged with the key socket attached to the crank plate. The teeth on the key bit can then transmit torque to the crank plate. However, the crank plate cannot be rotated at this point because the lock pins are engaged in the mating holes in the immovable lock plate. Rotation of the crank plate, and thus unlocking of the cover, requires that the crank plate be forcibly pushed axially downward to overcome a biasing spring that normally holds the crank plate pins in an engaged position. The axially downward force is transmitted through the key bit directly to the crank plate to overcome the spring bias. Once the crank plate is pushed downward sufficiently to disengage the lock pins, it is then rotated to retract the lock rods. The rotational movement of the crank plate can be limited by a rotation stop pin. Downward pressure can then be released, which causes the spring to force the crank plate back against the lock plate. The key handle is then captured between the crank plate and lock plate and can then be used to remove the heavy cover. That is, the key bit is no longer aligned with the pattern in the lock plate and cannot be removed until the lock rods are once again extended.

BRIEF DESCRIPTION OF THE DRAWINGS

The accompanying drawings, which are incorporated herein and form a part of the specification illustrate the preferred embodiment of the present invention, and together with the description, serve to explain the principles of the invention. In the drawings.

Figure 2:
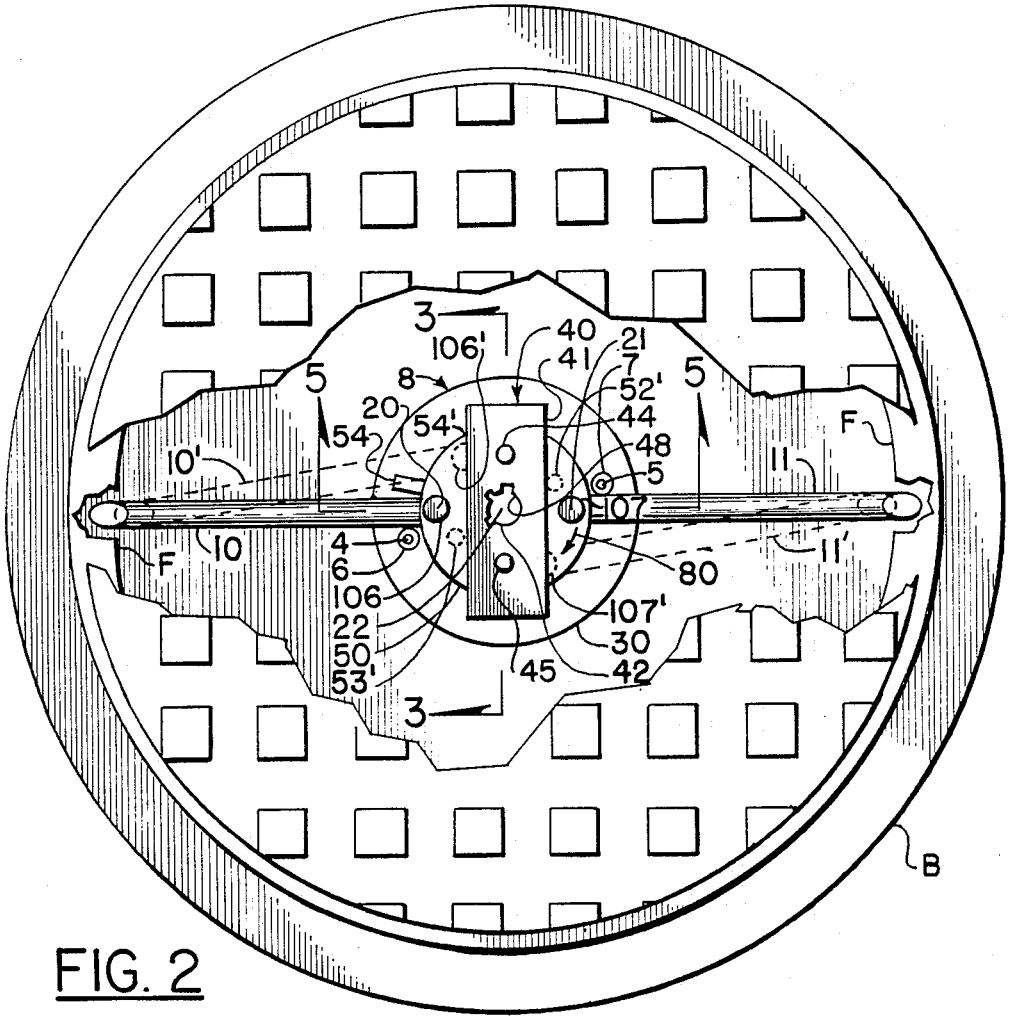
FIG. 2 is a top plan view of the present invention with a portion of the top of the manhole cover broken away to better reveal the locking apparatus.
Figure 6:
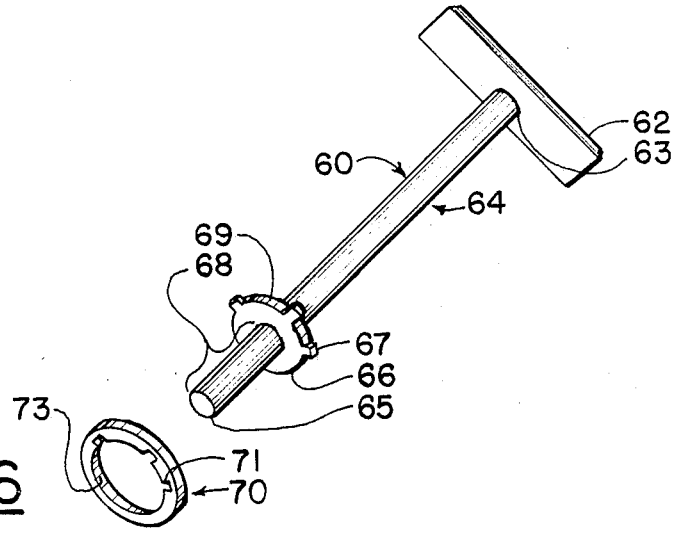
Figure 5:
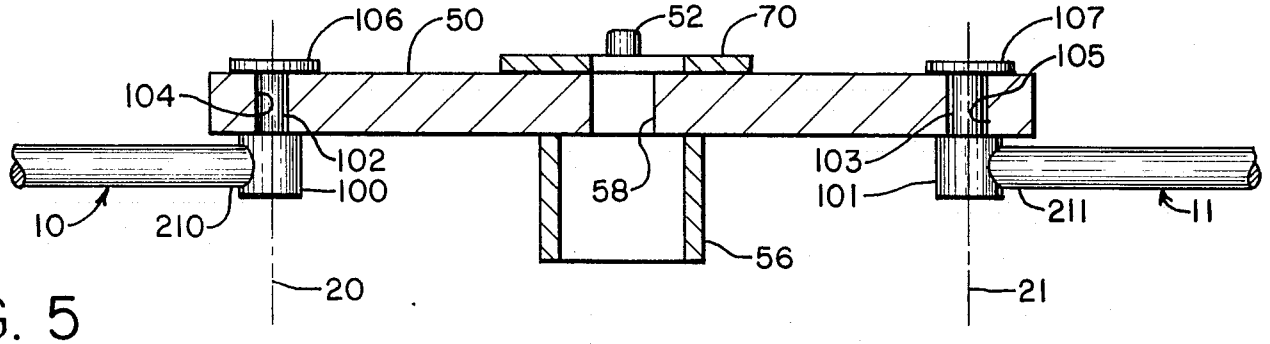

FIG. 5 is a side elevation view of the crank mechanism of the lock taken along line 5—5 of FIG. 2 showing the crank plate and the pivotal mounting of the lock rods;

FIG. 6 is an isometric view of the key showing the arrangement of the key bit on the shank according to this invention and how it aligns with the key socket.

DETAILED DESCRIPTION OF THE PREFERRED EMBODIMENT

Figure 1:
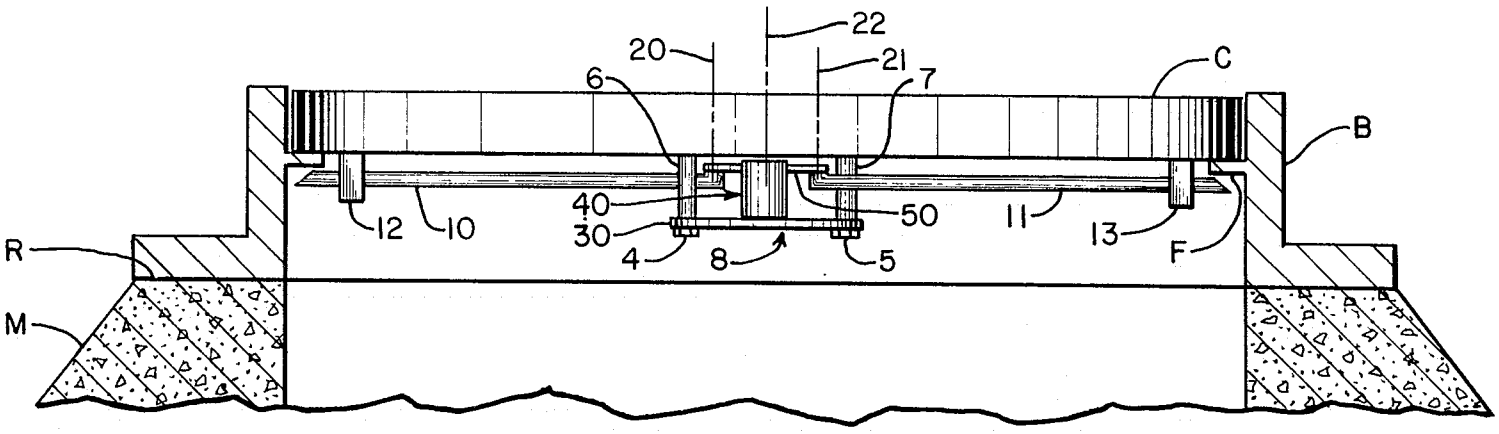
FIG. 1 is a side elevation view of a typical manhole cover positioned in a neck of a manhole structure and equipped with the locking apparatus of the present invention in the locked condition, a portion of the neck of the manhole being broken away to better reveal the locking apparatus.

A manhole cover C equipped with the locking apparatus 8 according to the present invention is shown in FIGS. 1 and 2 for locking the manhole cover C to the cover seat or support base B. The cover C is shown in its normal seated position resting on an annular flange F that is part of manhole support or seating base B. The support base B is shown as a typical annular neck opening, usually made of cast iron, that mounts on the top rim R of a concrete manhole structure M. The cover C is shown in FIGS. 1 and 2 locked by lock apparatus 8 to the base B by a suitable latching mechanism, such as lock rods 10 and 11. That is, lock rods 10 and 11 are extending under the flange F. The apparatus 8 is also shown in its unlocked or retracted position by the phantom lines in FIG. 2.

The locking apparatus 8 is concentrically and immovably mounted on the underside of circular manhole cover C by attachment bolts 4, 5. An access hole 14 extends through the cover C to allow insertion of a key (not shown in FIGS. 1 and 2, but shown as described later in FIGS. 4 and 6) into the locking apparatus 8. Briefly, locking apparatus 8 is comprised of a retainer plate 30, bolted to the underside of the manhole cover C, a securing apparatus comprising a lock frame 40 mounted on the retainer plate 30, and a latch actuator, such as a rotatable member or crank plate 50 and biasing spring (not shown in FIG. 1 mounted on the retainer plate 30 under the frame 40). The interaction of these components will be described more completely below.

Figure 3:
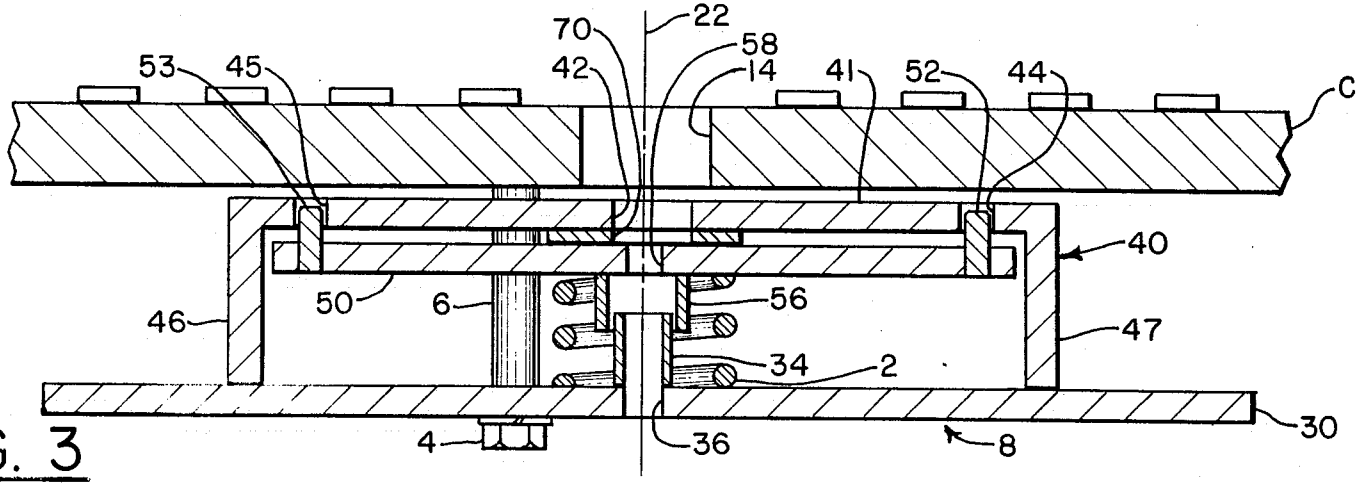
FIG. 3 is a cross-sectional view of the locking apparatus taken along line 3—3 of FIG. 2 showing the crank plate in its locked position.

As best seen by reference to FIGS. 1, 2 and 3, the lock apparatus 8 is fastened to the underside of cover C with two elongated bolts 4, 5. Elongated sleeves or spacers 6, 7 are positioned on the bolts 4, 5 to hold a predetermined distance between the cover C and retainer plate 30 to accommodate the other components of the lock apparatus 8.

Essentially, the crank plate 50 is mounted in a rotatable manner on the retainer plate 30 and can be rotated with a key (not shown in FIGS. 1–3). The lock rods 10, 11 are pivotally attached to crank plate 50, so that rotation of crank plate 50 causes radial extension of lock rods 10, 11 into engagement with flange F of manhole base B. Likewise, opposite rotation of crank plate 50 causes radial retraction of lock rods 10 and 11 into their retracted positions 10′ and 11′, as seen by the phantom lines of FIG. 2. However, to effect such rotation of crank plate 50, the special key (not shown in FIGS. 1–3) has to first move crank plate 50 downward to disengage a locking apparatus comprising locking pins 52, 53 from respective capturing or lock holes 44, 45, and then rotate crank plate 50 in the direction of arrow 80. Rotation requires a match of the key with the interior aperture of a special key pattern 42 in lock frame 40 and a special key socket 70, as will be described in more detail below.

Figure 4:
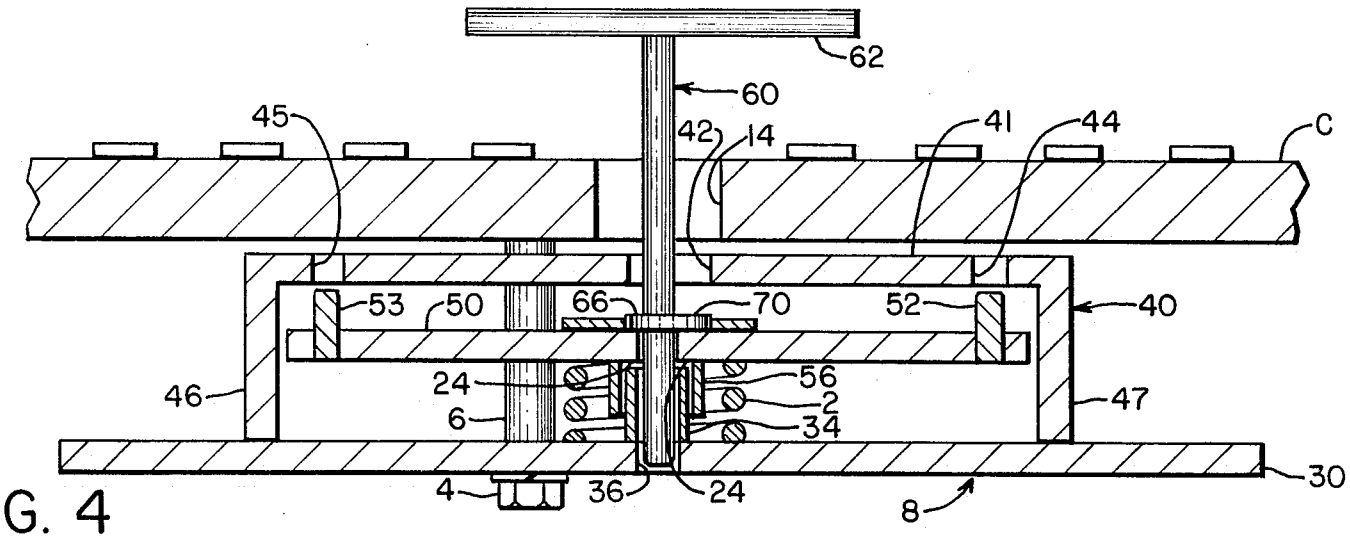
FIG. 4 is a cross-sectional view of the locking apparatus similar to FIG. 3 and taken along the same line 3—3 of FIG. 2, but showing the axial displacement of the crank plate required to disengage the lock pins.

The retainer plate 30 is a circular plate, as shown in FIG. 2, having a plurality of mounting bolts 4, 5 to immovably attach the retainer plate 30 to cover C as shown in FIG. 1. Sleeves 6, 7 are used to displace retainer plate 30 downward from the underside of cover C to allow sufficient clearance for the lock frame 40, as described above. Retainer plate 30 has a clearance hole 36 therethrough that is concentric with the axis of rotation 22 of crank plate 50. Clearance hole 36 allows clearance for the shank 64 of a key 60, as best seen in FIG. 4. The retainer plate 30 also has a cylindrical hub 34 concentric with hole 36 and extending upwardly toward the cover C for rotatably mounting the crank plate 50.

Lock frame 40 is comprised of horizontal plate 41 that is essentially parallel to, and positioned a short distance beneath, cover C and is retained in that position by legs 46, 47 extending downwardly and immovably attached to retainer plate 30. Thus, lock frame 40 forms an inverted U-shaped section, as best seen in FIG. 3. The horizontal plate 41 of lock frame 40 has a pair of capturing or lock pin holes 44, 45 extending therethrough at respective radially outward spaced positions on opposite sides of a central key pattern hole 42, as illustrated in FIG. 2. Central key pattern hole 42 has a plurality of cut-outs 43 in interior surface 48. The pattern formed by the cut-outs 43 must match that of key socket 70 and key bit 66 as more thoroughly described below.

The details of the rotatable crank plate 50, as best seen in FIGS. 2, 3, 4, and 5, is a circular configuration with a diameter smaller than the distance between lock frame legs 46, 47, as shown in FIG. 3. A hole 58 extends through the central axis of crank plate 50 in axial alignment with the hub 34 of retainer plate 30, as shown in FIG. 3. An annular sleeve 56 concentric with the hole 58 extends downwardly toward retainer plate 50 and has an inside diameter slightly larger than the outside diameter of hub 34. Crank plate 50 is rotatably and slidably mounted on retainer plate 30, hub 34 inserted into sleeve 56, and is disposed between retainer plate 30 and horizontal plate 41. Crank plate 50 can therefore rotate about, and slide axially along, axis 22. As shown in FIG. 5, the proximal ends 210, 211 of lock rods 10, 11 are pivotally connected to diametrically opposite sides of crank plate 50. Specifically, the proximal ends 210, 211 of lock rods 10, 11 are immovably attached to respective mounting lugs 100, 101. Each lug 100, 101 has an upwardly extending pivot shaft 102, 103 respectively. The pivot shafts 102, 103 are sized to allow sliding fits in rod pivot holes 104, 105 that are concentric with the lock rod pivot axes 20, 21. Flange bushings 106, 107 are immovably attached to shafts 104, 105, respectively, thereby pivotally attaching lock rods 10, 11 to the crank plate 50. Also shown in FIG. 5 is key bit 70, key shank hole 58, and downwardly extending sleeve 56.

A locking apparatus comprising protruding locking pins 52, 53 project upwardly from the upper surface of crank plate 50, as shown in FIGS. 3 and 4 and are positioned to engage the lock pin holes 44, 45 in horizontal plate 41 when the lock rods 10, 11 are in the radially extended position, thereby prohibiting any rotation of crank plate 50. This positioning requires the lock rod pivot axes 20, 21 to be located approximately 90° from the lock pins 52, 53, as shown in FIG. 2. Therefore, to retract rods 10, 11, the crank plate 50 has to be displaced downwardly first to disengage pins 52, 53 from holes 44, 45, then the crank plate 50 can be rotated in the direction of arrow 80 to move the lock rods to their retracted positions 10' and 11' as shown in FIG. 2.

The sequential downward displacement and then rotation of crank plate 50 to retract rods 10, 11, to positions 10' and 11' thus to unlock the manhole cover C for removal from base B, as described above, can be accomplished with a special key 60, the structure of which is best seen in FIG. 6.

The key 60 has a handle 62 immovably attached to the proximal end 63 of shank 64. A key bit 66 having at least one tooth 67 is immovably attached to shank 64 and axially displaced from the distal end 65 a distance 68. The key bit 66 can be designed with one or more teeth 67 arranged around its circumference and extending radially outward or with any other arbitrary pattern around its peripheral surface 69. A mating key socket 70 is provided with an interior surface 73 and is immovably affixed to the top surface of crank plate 50, as shown in FIGS. 3–5. The configuration or pattern of the interior surface 73 of key socket 70, as shown in FIG. 6 matches or mates with the teeth 67 or other arbitrary pattern in the peripheral surface 69 of key bit 66. Note that key socket 70 is shown in FIG. 6 without crank plate 50 for clarity only. In actual structure, key socket 70 is affixed to crank plate 50, as shown in FIGS. 3–5. The teeth-67 or other arbitrary pattern in the peripheral surface 69 are arranged to engage corresponding cut outs 71 in key socket 70. Whatever pattern is selected for key bit 66 must be the same as that selected for key pattern hole 42 and key socket 70. In this manner, a given key 60 will only access manhole covers having the matching pattern. A key shank hole 58 passes through the central axis of crank plate 50 to allow passage of shank 64 of key 60. Key bit 70, which is immovably attached to the upper surface of the crank plate 50, is axially aligned with hole 58 in crank plate 50. A biasing compression spring 2 is disposed between retainer plate 30 and crank plate 50 and around sleeve 56, as shown in FIGS. 3 and 4, to keep lock pins 44, 45 engaged in lock holes 52, 53 when in the locked position.

Operation of the invention is best understood by referring to FIGS. 2, 3 and 4. As discussed earlier, FIG. 2 shows the invention in the locked position as solid lines and in the unlocked position as phantom lines. FIG. 3 also shows the invention in the locked position, i.e., with lock pins 52, 53 engaged with lock holes 44, 45 of horizontal plate 41 of lock frame 40. The spring 2 biases the key socket 70 firmly against the underside of horizontal plate 41 of lock frame 40. In the locked position, the locking rods 10, 11 extend through lock rod guides 12, 13 under annular flange F of support base B, thereby locking the cover C in place as shown in FIG. 1. To unlock the manhole cover C, key 60 is inserted through access hole 14, as shown in FIG. 4. The key pattern 42 in horizontal plate 41 must be in alignment with key socket 70 when the crank plate 50 is in the locked position. Additionally, the key pattern 42 and key socket 70 must match that particular tooth arrangement of key bit 66 on key 60. If the key pattern alignment described above is followed, the key 60 can be fully inserted through hole 42 in lock frame 40 to engage key socket 70. The teeth 67 or other pattern engaging the mating key socket 70 enables rotation of the crank plate 50 in the direction of arrow 80 once the crank plate 50 has been moved axially to disengage lock pins 52, 53 from holes 44, 45 in plate 41.

FIG. 4 shows the configuration of the crank plate 50 in the disengaged position. The plate 50 is disengaged by applying an axially downward force on crank plate 50 with key 60. Key bit 66 transmits the downward force to the crank plate 50 to overcome the upward bias of spring 2. Downward movement of the crank plate 50 is limited by the upwardly extending hub 34, which contacts the underside of crank plate 50 at bearing surface 24. The same result could be achieved by shortening the hub 34 and extending sleeve 56 so that the bearing surface is on the retainer plate 30. Once the lock pins 52, 53 have been disengaged from the lock holes 44, 45 of surface 41, the crank plate 50 can be rotated to retract the lock rods 10, 11 by turning the key handle 62. That is, the engagement of key bit 66 with key socket 70 allows the torque applied by key 60 to be transmitted to the crank plate 50, thereby retracting the lock rods 10, 11.

Once the lock pins 52', 53' (i.e., pins 52 and 53 in the retracted position) have cleared the horizontal plate 41, as shown by the phantom lines in FIG. 2, the downward force on key 60 can be removed allowing the biasing spring 2 to move the crank plate 50 upward and seat the key bit 66 against horizontal plate 41. The key bit 66 is then held captive between the crank plate 50 and the horizontal plate 41, because the key bit 66 and teeth 67 are no longer in alignment with the key pattern of hole 42. The misalignment of the key pattern of hole 42 and key bit 66 will keep the key 60 captive in all positions except the locked position. Therefore, the key handle 62 can then be used to pull up and remove the manhole cover C from the base B. The stop pin 54' (i.e., pin 54 in the retracted position), located on the circumference of crank plate 50 and strikes a leg 47 to prevent excessive rotation of crank plate 50 as seen by the phantom lines in FIG. 2.

Installation and locking of the cover C is base B is the reverse of the above. The cover is lifted into place on flange F by the now captive key 60. Once the cover is properly positioned, the key 60 is pushed downward until sleeve 34 contacts bearing surface 24 on crank plate 50. Lock pins 52, 53 now clear the horizontal plate 41, and key 60 is rotated until the lock pins 52, 53 reengage holes 44, 45 at which point the key bit 66 or teeth 67 again are aligned with the corresponding key pattern of aperture 42 in plate 41. The key 60 can then be removed.

The foregoing is considered as illustrative only of the principles of the invention. Further, since numerous modifications and changes will readily occur to those skilled in the art, it is not desired to limit the invention to the exact method as shown and described, and accordingly, all suitable modifications and equivalence may be considered as falling within the scope of the invention as defined by the claims which follow.

The embodiments of the invention in which an exclusive property or privilege is claimed are defined as follows:

1. Lock apparatus for locking a cover onto a seating base wherein the cover is a disk-shaped body with a top surface, a bottom surface, and a peripheral edge and the seating base has an annular flange adapted to support the cover by bearing on the bottom surface of the cover adjacent its peripheral edge, said lock apparatus comprising:

latch means attached to the bottom surface of the cover for realeasably engaging said annular flange in a manner that prevents movement of said cover away from said flange when said lock means is engaged;

latch actuator means connected to said latch means for engaging and disengaging said latch means, said latch actuator including a rotatable member that actuates said latch means by rotational movement;

lock means associated with said latch actuator means in such a manner that said lock means releasably secures said rotatable member against rotation when said latch means is engaged with said flange, said lock means being configured to require movement of said rotational member in a direction parallel to its axis of rotation before it is rotatable in an angular direction to disengage said latch means; and removable key means for moving said rotatable member in said axial direction and for rotating said rotatable member.

2. The lock apparatus of claim 1, wherein said lock means includes securing means that is stationary with respect to said cover for releasably securing said rotatable member in relation to said cover.

3. The lock apparatus of claim 2, wherein said lock means includes a protrusion extending outward from said rotatable member and said securing means includes capture means for capturing and retaining said protrusion against movement in a direction other than parallel to said axis of rotation.

4. The lock apparatus of claim 3, wherein said protrusion is a pin protruding from said rotatable member in a direction parallel to said axis of rotation and in a position laterally displaced from said axis of rotation, and said capture means includes a capture hole in said securing means in a position to receive said pin when said latch means is engaged.

5. The lock apparatus of claim 4, including bias means associated with said rotatable member for biasing said rotatable member and pin toward said capture hole in said securing means.

6. The lock apparatus of claim 5, including retainer means attached to said bottom side of said cover and extending a spaced distance downwardly from said bottom side of said cover, rotatable mounting means on said retainer means for mounting said rotatable member thereon in a manner that allows both rotatable and longitudinal movement of said rotatable member with respect to said axis of rotation, and wherein said securing means includes a lock frame attached to said retainer means and having said capture hole therein aligned with said pin when said latch means is engaged.

7. The lock apparatus of claim 6, wherein said rotatable member is positioned between said lock frame and said retainer means, and wherein said bias means includes a resilient compressible member positioned between said rotatable member and said retainer means.

8. The lock apparatus of claim 7, wherein said rotatable member is a crank plate and latch means includes an elongated, radially extendable and retractable lock rod having a proximal end pivotally attached to said crank plate a spaced distance radially outward from said axis of rotation and a distal end adapted for engaging said flange.

9. The lock apparatus of claim 1, including key means adapted for moving said rotatable member in a direction parallel to said axis of rotation and for rotating said rotatable member in relation to said axis of rotation.

10. The lock apparatus of claim 9, wherein said key means includes a bearing surface on said rotatable member adapted to receive a force directed substantially parallel to said axis of rotation, socket means on said rotatable member for receiving and imparting an angular force directed to cause rotational movement of said rotatable member, and a key having an axial bearing surface adapted to impart an axially directed force on said bearing surface on said rotatable member and key bitting adapted to engage said socket means for imparting an angular force to said socket means.

11. The lock apparatus of claim 10, wherein said key includes an elongated shank having a proximal end with a handle attached thereto and a distal end with a collar near said distal end, said collar having said bearing surface on its side near said distal end and a peripheral surface forming a key bitting adapted for angular engagement with said socket means.

12. The lock apparatus of claim 11, wherein said peripheral surface key bitting has an arbitrary pattern and said socket means includes an opening having an interior surface with a shape sized and configured to correspond to, and matingly receive said key bitting.

13. The lock apparatus of claim 12, including a lock frame positioned adjacent said socket, said lock frame being immovably attached to said cover and having an opening therethrough in axial alignment with said socket, said opening in said frame having an interior surface that is also sized and configured to correspond with the pattern of the peripheral surface key bitting on said key, said cover also having a hole therethrough in axial alignment with said socket to accommodate insertion of said key through said cover and into said socket.

14. In a lockable cover having a plurality of radially extendable and retractable locking rods pivotally attached to a cranking means at their proximal ends and having their distal ends engaging an immovable locking flange fixed to a cover support base thereby locking the cover securely in position, and having a rotating means to rotate said cranking means to engage and disengage the lock rods, the improvement comprising:

a tamper-resistant locking means requiring a longitudinal movement and a rotational movement of the cranking means in order to engage and disengage the locking rods.

15. The improvement of claim 14 where the tamper resistant locking means comprises a retainer plate immovably attached to the manhole cover; a circular rotatable crank plate pivotally and slidably attached to the retainer plate; a lock plate immovably attached to the retainer plate by two downwardly extending legs such that the crank plate is pivotally and slidably positioned therebetween; a biasing means positioned between the retainer plate and the crank plate so as to keep the crank plate in contact with the lock plate; and a key for engaging the crank plate to translate and rotate said crank plate to extend and retract the lock rods.

16. The crank plate of claim 15, further comprising at least one upwardly protruding lock pin oriented to engage a hole in the lock plate to prevent rotation of the crank plate when it is in the locked position without prior downward movement of the crank plate against said biasing means.

17. The crank plate of claim 16 where the means of pivotally and slidably mounting the crank plate to the retainer plate is accomplished by a downward extending cylindrical flange concentric with a hole in the center of the crank plate and immovably attached to the circular crank plate that cooperates with an upward protruding cylindrical flange immovably attached to the retainer plate so as to form a bearing surface therebetween, and the length of both flanges being such to permit sufficient downward movement of the crank plate to disengage the lock pin.

18. The pivoting and sliding means of claim 17 were where said upwardly protruding flange on the retainer plate has an outside diameter smaller than the inside diameter of the downward extending flange on the crank plate.

19. The crank plate of claim 17 having a rotation stop pin immovably attached to the circumference of said crank plate and extending radially outward therefrom, positioned to prevent excessive rotation of the crank plate by contacting one of the downwardly extending legs of the lock plate.

20. The crank plate of claim 17 having a key socket immovably attached over the center hole in the crank plate to permit engagement of the lock key for disengaging and rotating the crank plate.

21. The lock plate of claim 15 further comprising a horizontal, rectangular surface having downwardly extending legs located at the ends of the horizontal rectangular surface having the smaller dimension for immovable attachment to the retainer plate, the horizontal rectangular surface thus being vertically displaced from the retainer plate and having at least one hole therethrough oriented to engage the lock pin of the crank plate and also having a notched keyhole therethrough concentric with the crank plate pivot axis and oriented to align with the key socket on the crank plate when the crank plate is in the locked position.

22. The key of claim 15 further comprising a shank, a handle immovably attached to the proximal end of the shank, and a key bit immovably attached to, but displaced some distance from the distal end of the shank for engaging the key socket of the crank plate.

23. The retainer plate of claim 15 further having a hole therethrough concentric with and of substantially the same diameter as the outside diameter of the key shank so as to allow the passage of the shank of the key and also having mounting holes conveniently located therethrough to allow attachment to the man hole cover.

24. The apparatus of claim 15 where the biasing means is a helical compression spring.

25. The apparatus of claim 15 where the crank plate has two diametrically opposed upwardly extending lock pins.

26. The apparatus of claim 25 where the lock plate has two diametrically opposed holes therethrough aligned to engage the lock pins when in the locked position.

* * * * *